US005130911A

United States Patent [19]

Eisner, Sr.

[11] Patent Number: 5,130,911

[45] Date of Patent: Jul. 14, 1992

[54] TWO PIECE LAMP HOLDER

[75] Inventor: Clifford L. Eisner, Sr., Henniker, N.H.

[73] Assignee: GTE Products Corporation, Danvers, Mass.

[21] Appl. No.: 812,307

[22] Filed: Dec. 23, 1991

[51] Int. Cl.[5] ..... H01R 33/00

[52] U.S. Cl. ..... 362/226; 362/263; 313/318

[58] Field of Search ..... 313/318; 362/226, 396, 362/263

[56] References Cited

U.S. PATENT DOCUMENTS 4,473,770 9/1984 Baba et al. ..... 362/226 X 5,039,904 8/1991 Kosmatka et al. ..... 362/267 X

*Primary Examiner*—Stephen F. Husar

[57] ABSTRACT

A lamp holder may formed from a plastic a retainer and insert. The retainer is designed to receive and a couple with a lamp capsule, and an insert. A flexible wall is formed intermediate the lamp socket cavity and the insert cavity, thereby allowing an end of the lamp capsule to be inserted in the lamp socket cavity. An insert having an appropriate size and shape is then inserted in the insert cavity, thereby preventing the flexible wall from further motion. The plastic material provides electrical insulation, and highly accurate injection molded shaping. The lamp capsule is then securely, and accurately fixed in place with a little assembly effort.

8 Claims, 3 Drawing Sheets

TWO PIECE LAMP HOLDER

TECHNICAL FIELD

The invention relates to electric lamps and particularly to lamp retainers. More particularly the invention is concerned with a two piece lamp retainer for holding a press sealed lamp capsule.

BACKGROUND ART

Background

Currently, most if not all headlamps are made with tungsten halogen capsules. The capsule is typically a glass or quartz tube that is press sealed. The capsule gets quite hot during operation, so the capsule is usually held by a metal retainer. Metal retainers commonly are either snap fitted around the press seal of the capsule, or formed from two pieces that are welded or crimped together to trap the press seal. The capsule end is then pinned by the surrounding metal retainer.

Metal retainers are not completely satisfactory. Since the retainer should not rust, or distort under prolonged exposure to heat, stainless steel is used, so cost of the metal is one problem. Each lamp capsule must be accurately located in the reflector and lens system, but forming metal accurately for each lamp requires expensive equipment, and constant monitoring. Metal is hard, and the metal retainer can apply great pressure to the lamp capsule, if the retainer is not formed accurately. A misformed metal retainer can close too closely on the glass or quartz capsule, causing the capsule to fracture or explode. Welding the metal pieces can also cause problems. Improper welds fail, releasing the metal pieces, allowing the lamp capsule to move from the ideal optical position of the lamp. Repositioning and rewelding the clamp then becomes a cost issue. There is then a need for a lamp holder that is not hard, welded or metal.

A metal retainer, in the case of an HID automotive headlamp, cannot be used to hold the capsule because of the high voltage needed to ignite the lamp. With a metal retainer, the ignition voltage may break down outside the lamp. If the voltage breaks down outside the lamp, the lamp does not ignite, which would be a general safety hazard for vehicle operation, and could be a personal safety issue for those working with the lamp. There is then a need for a nonconductive holder to support and insulate an HID lamp.

DISCLOSURE OF THE INVENTION

A lamp holder may be formed from a retainer made of a flexible, nonconductive material designed to receive and a couple with a lamp capsule, having a socket cavity wall defining a socket cavity and an insert cavity wall defining a insert cavity to mate with a insert. Intermediate socket cavity and insert cavity is a flexible wall. An insert having an appropriate size and shape may be positioned in the insert cavity, to conform with and abut at least portions of the flexible wall and other portions of the insert cavity, and when securely inserted in the insert cavity actually abuts the flexible wall, and other portions of the insert cavity and thereby resists the flexible wall from flexing away from the lamp socket cavity. The lamp capsule is then accurately and securely held in the holder.

BEST MODE FOR CARRYING OUT THE INVENTION

Figure 1:
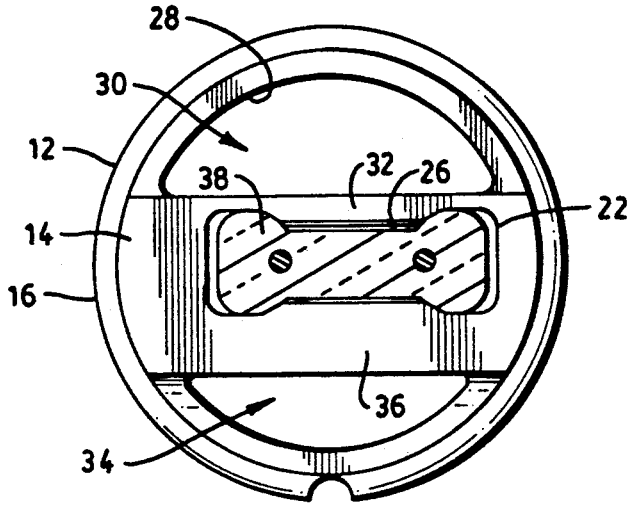
FIG. 1 shows a transaxial cross sectional view of the preferred embodiment of a lamp retainer.
Figure 2:
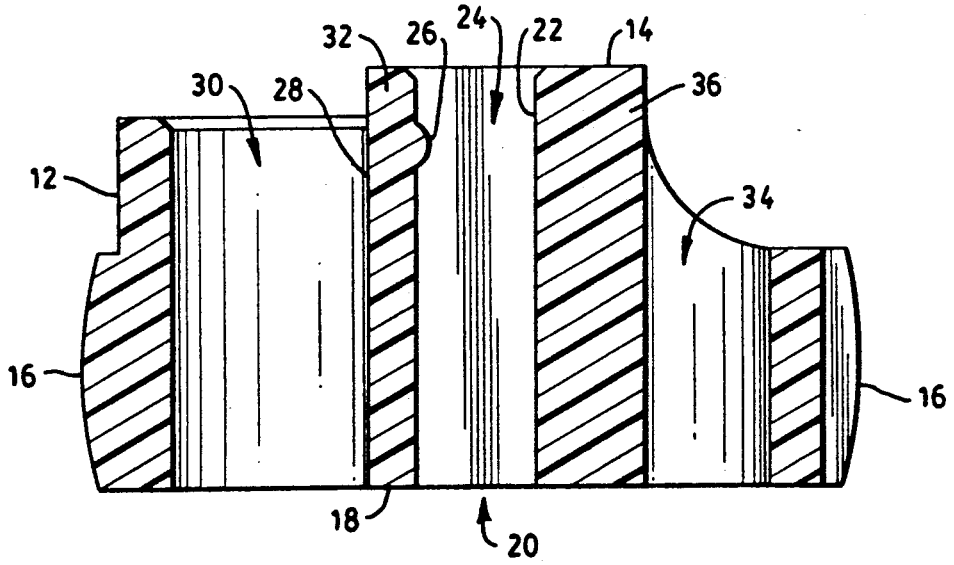
FIG. 2 shows an axial cross sectional view of the lamp retainer.
Figure 3:
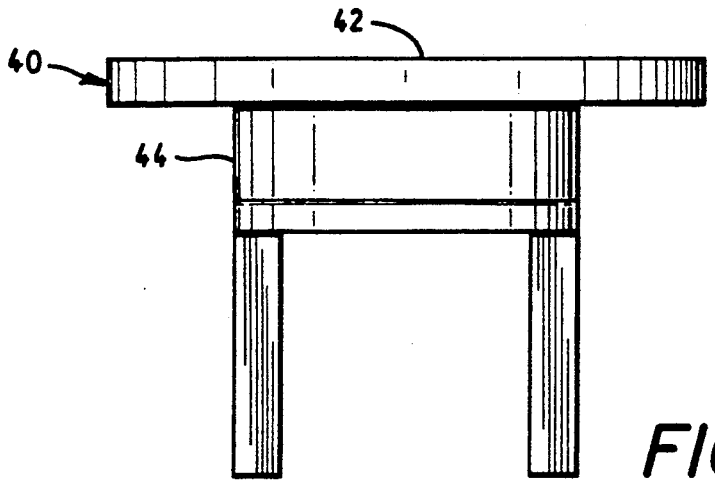
FIG. 3 shows a front view of the preferred embodiment of the lamp insert.
Figure 4:
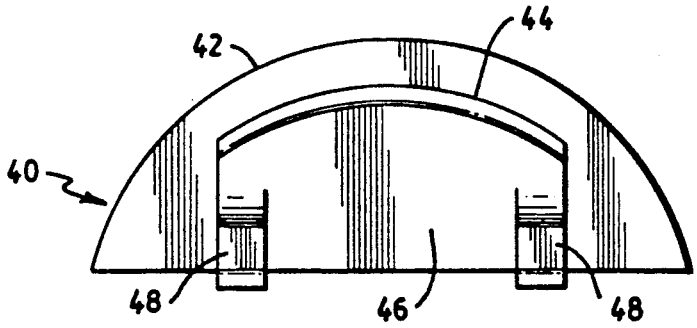
FIG. 4 shows a bottom view of the lamp insert.
Figure 5:
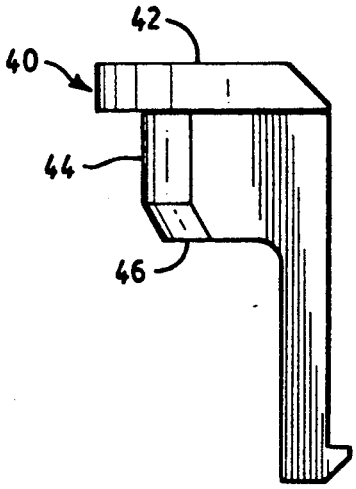
FIG. 5 shows a side view of the lamp insert.

A lamp holder may be formed from a lamp retainer 12, and an insert 40. FIG. 1 shows a transaxial, cross sectional view of a lamp retainer 12. The lamp retainer 12 has a retainer top 14, an exterior wall 16, a retainer bottom 18 and an axis 20 extending through the retainer top 14 and retainer bottom 18. In the preferred embodiment, the exterior wall 16 is a surface of rotation about the axis 20, and in part includes a diametric section of a sphere. The exterior wall 16 encloses an interior, lamp socket wall 22 defining a lamp socket cavity 24 open to the retainer top 14 in the axial direction. The lamp socket wall 22 may have surface features to conform with a press sealed lamp base. In the preferred embodiment, a transaxial rib 26 is formed in the lamp socket wall 22. The preferred press seal 38, in cross section, has a dog bone or bar bell shape, and the lamp socket wall 22, in transaxial cross section, has a similar form with portions having the same width or length as the lamp press seal 38 to thereby allow a snug mating with the adjacent portions of the lamp socket wall 22. In the preferred embodiment, the best mating surfaces occur where the press tools made contact with the lamp capsule, and not at the lamp capsule ends, or side corners, where small chips, if under pressure can evolve into fractures. In the preferred embodiment, the opposite side wall portions of the lamp socket wall 22 abut the adjacent side walls of the press seal 38. In the preferred embodiment, the end walls of the lamp socket wall 22 are offset from, and do not abut the end faces of the press seal 38.

The exterior wall 16 further encloses an interior, insert cavity wall 28, defining an insert cavity 30, that also opens to the retainer top 14 in the axial direction. The insert cavity wall 28 may also have surface features to conform with the insert 40. The preferred insert cavity 30 has the form of a chordal section of a circular cylinder, and the preferred insert 40 has a similar portion having the same width or length as the insert cavity 30 to thereby allow the insert cavity 30 to be snuggly filled by the insert 40, with portions of the retainer 12 being braced by adjacent portions of the insert 40.

Intermediate the lamp socket cavity 24 and the insert cavity 30 is a thin wall 32. The lamp retainer 12 material is chosen to be somewhat flexible, so the thin wall 32 may flex or bend with the insertion of the press seal 38 into the lamp socket cavity 24. The preferred retainer material is a high temperature plastic such as a 45 percent glass filled polyphthalamide (PPA), for example Amodel 1145. The preferred material shows a high heat distortion temperature, high flexural modulus and high tensile strength, with excellent creep resistance. The material is relatively insensitive to moisture, has good dimensional stability, can be injection molded by conventional means, and can have very smooth surfaces. Formed on the lamp socket cavity 24, the rib 26 then is part of the thin wall 32. When the press seal 38 is properly inserted in the lamp socket cavity 24, the thin wall 32 flexes to let the press seal 38 pass over the rib 26 and then snaps closed against the press seal 38 as the rib 26 seats in a conformal portion of the press seal 38. The press seal 38 is then seated against the lamp socket wall 22.

The retainer 14 may also include an internal wall defining a potting material access passage 34. In the preferred embodiment, next to the lamp socket cavity 24, away from the insert cavity 30 is a potting material access passage 34 that extends from the retainer top 14 through to the retainer bottom 18. The access passage 34 allows potting material to be flowed into the volume under the lamp retainer 12 after the lamp is assembled. The preferred access passage 34 is a chordal section of a circular cylinder. The preferred insert cavity 30, and the access passage 34 then leave the lamp socket cavity 24 formed in a cross bar structure extending across a retainer ring. The cross bar wall between the lamp socket cavity 24 and the insert cavity 30, the thin wall 32, depending on the material chosen, is formed with a thickness dimension, sufficiently thin so as to be flexible. The opposite cross bar wall, the wall between the lamp socket cavity 24 and the potting access passage 34, is preferably formed with a greater thickness dimension, a dimension sufficiently thick to resist flexing during capsule insertion or lamp operation.

FIGS. 3, 4, 5 and 6 show respectively a front, bottom, side and perspective view of an insert 40. The preferred insert 40 has an insert top 42, insert midsection 44, and an insert bottom 46. The preferred insert top 42 has the general form of a chordal section of a circular cylinder. The insert midsection 44 has the form of a chordal section of a smaller diameter cylinder. Extending from the bottom of the insert midsection 44 are one or more catches 48, hooks or other means of snap locking the lamp retainer 12 and insert 40. The insert cavity 30 and the insert 40 have similar dimensions, to allow the lamp retainer 12 along the insert cavity 30 to be mated to the insert 40, and thereby conformally couple at least some adjacent portions of the insert cavity wall 28, and the insert 40. In particular the retainer thin wall 32 is mateable with at least portions of the adjacent insert 40.

The walls of the insert cavity 30 abut the adjacent walls of the insert 40. The thin wall 32 contacts the insert 40 along one face, and other portions of the insert cavity 30 abut other portions of the insert 40 the along other faces. The thin wall 32 is reinforced by the insert 40. The thin wall 32 is prevented from flexing when the insert 40 is in position. With the thin wall 32 pinned in place by the insert 40, the press seal 38 is then locked in place. The reinforced thin wall 32 is prevented from moving, and the conformal locking between the press seal 38 and the adjacent surface features of the lamp socket wall 22 lock the lamp retainer 12 and press seal 38 together.

Figure 7:
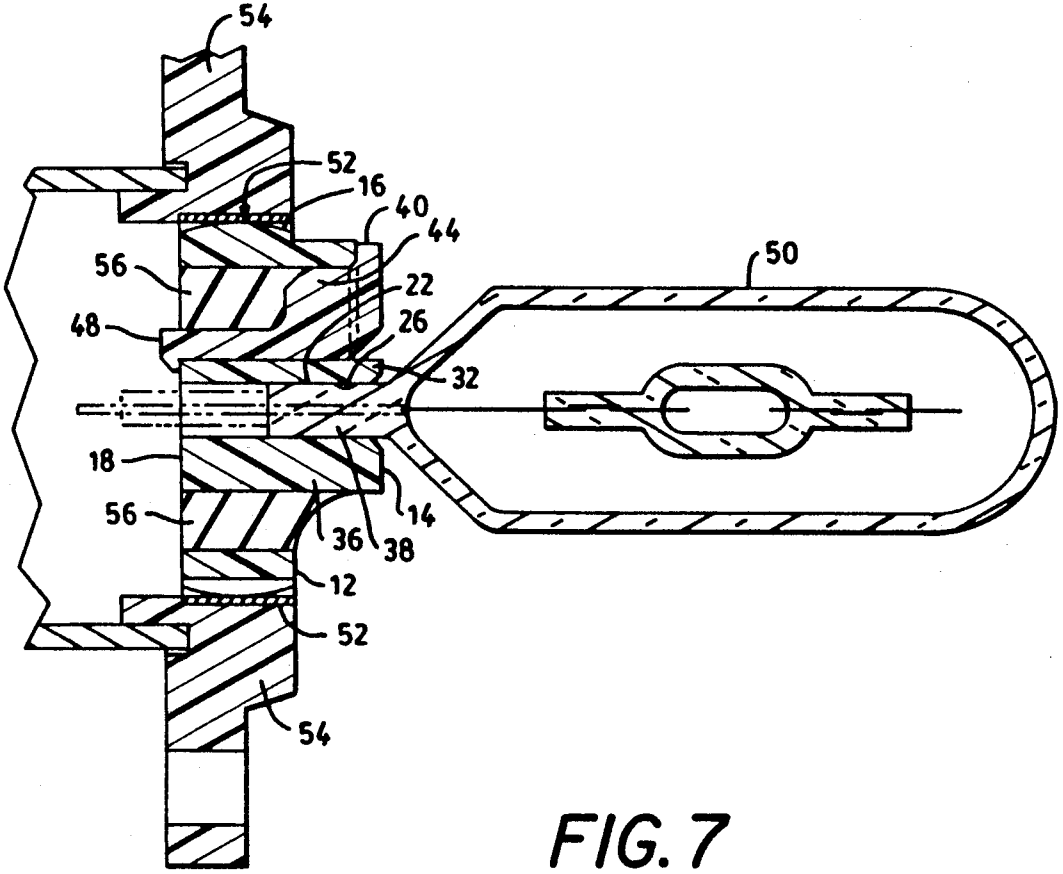
FIG. 7 shows an axial cross sectional view of a two piece lamp retainer, an arc discharge lamp capsule, and a lamp base, partially broken away.
Figure 6:
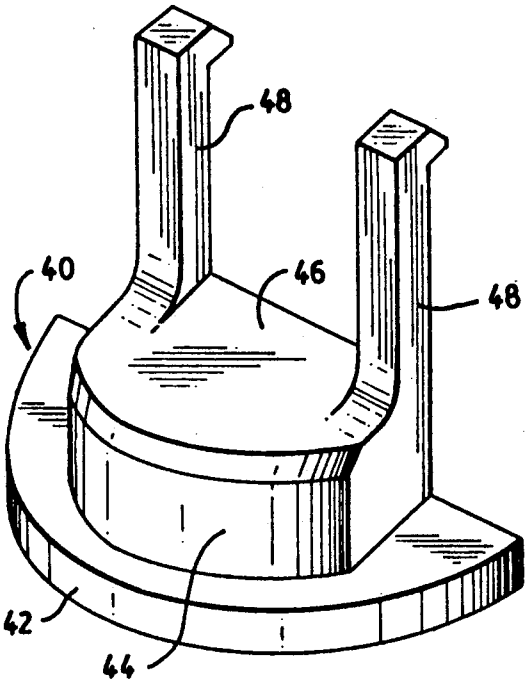
FIG. 6 shows a perspective view of the lamp insert.

FIG. 7 shows an axial, cross sectional view of a two piece lamp retainer 12, an arc discharge lamp capsule, and a lamp base, partially broken away. The lamp retainer 12, and insert 40 are positioned around the press seal 38 of the lamp capsule with the lamp socket wall 22 and rib 26 firmly coupled to the lamp capsule. The lamp retainer 12 along the spherical section of exterior wall 16 is further positioned in a metal ring 52 that is held in turn in a lamp base 54. The exterior wall 16 of the lamp retainer 12 then abuts the metal ring 52 held by the lamp base 54. The spherical section may then be inserted and slid along the tubular length of the metal ring 52 providing axial adjustment of the lamp retainer 12, and therefore the lamp capsule. The lamp retainer 12 may also be axially rotated around the metal ring 52 axis. The lamp retainer 12 may also be spherically pivoted, so the lamp retainer axis 20 is at an angle to the lamp base axis. By these adjustments, the lamp capsule may be properly positioned with respect to the lamp base 54. When properly positioned, the lamp retainer 12 may be locked in place with respect to the lamp base 54. The lamp retainer 12 may be locked to the lamp base 54 by radio frequency heating of the metal ring 52 held by the lamp base 54 adjacent the lamp retainer 12 The lamp retainer's 12 exterior wall 16 is then melted, and fused against the metal ring 52.

Potting material 56 may be inserted through the potting access passage 34 to fill the cavities adjacent the lamp retainer 12 and the lamp base 54. The potting material 56 fills the cavities around the lamp base 54, and the lamp leads. The potting material 56 is chosen to have good flow characteristics, high thermal stability, and good insulation while still remaining flexible. The preferred potting material 56 is flexible enough to not transmit damaging forces to the lamp capsule that might break the jacket, or might crack and admit water to allow electrical short circuits. The preferred potting material 56 is a polyurethane material with one part resin by volume and about four parts catalyst by volume. The potting material 56 then excludes water, oil, dirt, and electrically insulates the lamp lead connections. Other methods of joining the holder and base pieces may be used.

The retainer 12 and insert 40 structures may be assembled in a lamp base by fitting a press seal 38 of a lamp capsule 50 in the lamp socket cavity 24, causing the thin wall 32 to flex to admit the press seal 38 into the cavity. The thin wall 32, with the internally formed rib 26, close on the press seal 38, mating the rib 26 with an indentation formed on the press seal 38. The insert 40 may be slipped, insert catches 48 first, along the lamp capsule 50 and into the insert cavity 30. The insert top 42 mates with the retainer top 14 along the insert cavity 30, with the chordal side abutting the top side portion of the thinner cross bar wall, thin wall 32. The insert midsection 44 snuggly fits in the insert cavity 30. The insert midsection 44 chordal face abuts the thinner cross bar wall thin wall 32, on one side, while the opposite side, the cylindrical face, abuts the exterior side of the insert cavity 30. The midsection 44 thereby bridges the volume between the cylindrical side of the insert cavity wall 28, and the thinner cross bar wall, thin wall 32. The insert 40 thereby braces, and held the thinner cross bar wall, thin wall 32, in position, pressing snuggly against the press seal 38. During insertion, the insert catches 48 are compressed as they run along the insert cavity wall 28. When the insert 40 is completely advanced into the insert cavity 30, the compressed insert catches 48 emerge from the bottom of the insert cavity 30, and the hooked ends spring open, clipping around the bottom edge of the retainer 40. The broader insert top 42 abuts the top edge of the insert cavity wall 28, thereby stopping the insert 40 from further insertion. The lamp capsule 50 is firmly anchored to the retainer 12, and the quartz lamp capsule was not stressed during the assembly.

In a working example some of the dimensions were approximately as follows: the retainer was a circular ring with a diametric cross bar form with an included lamp socket cavity to receive and couple with a press sealed end of a lamp capsule. The exterior wall had a diameter of 26.98 millimeter. The lamp cavity in cross section had a dog bone or bar bell shape. The lamp cavity had a length of 16.92 millimeter, and a width of 4.013 millimeter, discounting an internal rib. The lamp socket cavity was not centered on the lamp retainer axis, because the light source was not located centrally in the lamp capsule. The offset in the retainer then corrected for the offset in the capsule. One side of the cross bar was thinner than the other thereby being slightly flexible. The thinnest sections, those near the dog bone or bar bell ends were about 1.0 millimeter thick. The lamp socket cavity walls were axially smooth except for a rib formed on the thinner cross bar section. The rib was formed to mate with an indentation running transaxially along the press seal of the lamp capsule. The central section was 1.57 millimeter, and the rib stood out 0.407 millimeter. Between the exterior wall and the thinner side of the cross bar was an axially extending insert cavity having in cross section a circular section and axially smooth walls. The perpendicular distance from the cross bar to the insert cavity wall was 6.756 millimeter. The top lip of the insert cavity was stepped down from the top edge of the cross bar, and extended in a plane perpendicular to the retainer axis. Between the exterior wall and the thicker side of the cross bar was an axially extending potting access passage having in cross section a circular section and axially smooth walls. The bottom of the retainer was flat, extending perpendicularly from the retainer axis. The insert comprised a top, formed from a chordal section of a circular cylinder, a narrower midsection also formed from a chordal section of a circular cylinder, and two prongs extending from the bottom of the midsection. Each of the prongs had a hooked end to clip to the retainer bottom when properly positioned.

With the above working example, No lamp capsule chips or cracks have been detected in assembled lamps as a result of the assembly process. The disclosed dimensions, configurations and embodiments are as examples only, and other suitable configurations and relations may be used to implement the invention.

While there have been shown and described what are at present considered to be the preferred embodiments of the invention, it will be apparent to those skilled in the art that various changes and modifications can be made herein without departing from the scope of the invention defined by the appended claims.

I claim:

1. A lamp holder comprising:

a) a retainer to receive and a couple with a lamp capsule, having a top side, an exterior wall, a bottom side, a socket cavity wall adjacent the top side defining a socket cavity, and an insert cavity wall defining an insert cavity to mate with an insert, and a flexible wall formed intermediate the lamp socket cavity and the insert cavity, and b) an insert having a size and shape to be positioned in the insert cavity, and conform with and abut at least portions of the flexible wall and other portions of the insert cavity, and securely inserted in the insert cavity to abut at least portions of the flexible wall, and at least portions of the insert cavity wall to thereby resist the flexible wall from flexing away from the lamp socket cavity.

2. The lamp holder in claim 1, wherein the socket cavity wall is formed with surface features to mate with similar features formed on a lamp capsule.

3. The lamp holder in claim 1, wherein the socket cavity wall extends to at least one lead channel extending through the lamp holder to the bottom side.

4. The lamp holder in claim 1, further including a potting access passage extending from the top side through the holder to the bottom side.

5. The lamp holder in claim 1, wherein the exterior wall is a surface of rotation about an axis of the lamp holder.

6. The lamp holder in claim 5, wherein the exterior wall includes spherical section.

7. The lamp holder in claim 1, wherein the insert includes means for clipping the insert to the retainer.

8. The lamp holder in claim 1, wherein the insert has a shape and size to snuggly fit in the insert cavity, and substantially fill the insert cavity.

* * * * *